US009328903B2

(12) United States Patent
Holder

(10) Patent No.: US 9,328,903 B2
(45) Date of Patent: May 3, 2016

(54) RESIN-BASED LIGHTING FIXTURES AND METHODS OF FORMING THE SAME

(71) Applicant: 3form, LLC, Salt Lake City, UT (US)

(72) Inventor: Ahna C. Holder, Seattle, WA (US)

(73) Assignee: 3Form, LLC, Salt Lake City, UT (US)

( * ) Notice: Subject to any disclaimer, the term of this patent is extended or adjusted under 35 U.S.C. 154(b) by 84 days.

(21) Appl. No.: 14/526,418

(22) Filed: Oct. 28, 2014

(65) Prior Publication Data

US 2015/0047174 A1 Feb. 19, 2015

Related U.S. Application Data

(62) Division of application No. 13/653,288, filed as application No. PCT/US2011/034358 on Apr. 28, 2011.

(60) Provisional application No. 61/330,196, filed on Apr. 30, 2010.

(51) Int. Cl.

| | |
|---|---|
| ***F21V 17/06*** | (2006.01) |
| ***A41G 1/00*** | (2006.01) |
| ***F21S 6/00*** | (2006.01) |
| ***F21S 8/06*** | (2006.01) |
| ***F21V 1/22*** | (2006.01) |
| *F21W 121/00* | (2006.01) |

(52) U.S. Cl.

CPC . *F21V 17/06* (2013.01); *A41G 1/00* (2013.01); *F21S 6/002* (2013.01); *F21S 8/06* (2013.01); *F21V 1/22* (2013.01); *F21W 2121/00* (2013.01); *Y10T 29/49826* (2015.01)

(58) Field of Classification Search

CPC ..... F21V 17/06; F21V 1/22; A41G 1/00; F21S 6/002; F21S 8/06; Y10T 29/49826; F21W 2121/00

See application file for complete search history.

(56) References Cited

U.S. PATENT DOCUMENTS

| | | | | |
|---|---|---|---|---|
| 3,050,619 | A | 8/1962 | Abramson | |
| 3,137,610 | A | 6/1964 | Flynn | |
| 3,433,939 | A | 3/1969 | Lothman | |
| 3,619,598 | A | 11/1971 | Hermanson | |
| 4,340,625 | A | 7/1982 | Willinger | |
| 4,957,787 | A | 9/1990 | Reinhardt | |
| 5,899,555 | A | 5/1999 | Lin | |
| 6,719,439 | B1 | 4/2004 | Tseng | |
| 6,776,511 | B1 | 8/2004 | Lindsay | |
| 7,504,159 | B1 | 3/2009 | Suare | |
| 8,991,026 | B2 * | 3/2015 | Blonder | A41G 1/00 29/428 |
| 2,881,545 | A1 | 4/2015 | Decamp | |
| 2002/0031620 | A1 | 3/2002 | Yuzawa | |
| 2005/0231975 | A1 | 10/2005 | Bixler | |
| 2006/0243291 | A1 | 11/2006 | Daley | |
| 2009/0052168 | A1 | 2/2009 | Chen | |
| 2009/0219711 | A1 | 9/2009 | Webb | |
| 2010/0097790 | A1 | 4/2010 | Tseng | |

* cited by examiner

*Primary Examiner* — Ryan J Walters
(74) *Attorney, Agent, or Firm* — Workman Nydegger

(57) ABSTRACT

Resin-based lighting fixtures provide both light and a desirable aesthetic. The resin-based lighting fixtures include a plurality of propellers having curved resin strips that at least partially conceal a light source. The resin strips can form any number of aesthetically pleasing configurations, such as, for example, a blossom. The resin strips can be transparent or translucent. When lit, the light source can illuminate the resin strips.

8 Claims, 8 Drawing Sheets

RESIN-BASED LIGHTING FIXTURES AND METHODS OF FORMING THE SAME

CROSS-REFERENCE TO RELATED APPLICATIONS

The present invention is a divisional of U.S. patent application Ser. No. 13/653,288, filed Oct. 16, 2012, which is a 35 U.S.C. §371 U.S. National Stage of PCT Patent Application No. PCT/US2011/34358, filed on Apr. 28, 2011, which claims the benefit of priority to U.S. Provisional Application No. 61/330,196, filed Apr. 30, 2010. The entire content of each of the foregoing patent applications is incorporated by reference herein.

BACKGROUND OF THE INVENTION

1. The Field of the Invention

Implementations of the present invention relate to decorative resin lighting fixtures.

2. Background and Relevant Art

Recent trends in building design involve using one or more sets of decorative panels to add to the functional and/or aesthetic characteristics of a given structure or design space. These recent trends are due, at least in part, because there is sometimes more flexibility with how the given panel (or set of panels) is designed, compared with the original structure. For example, recent panel materials include synthetic, polymeric resin materials, which can be formed as panels to be used as partitions, walls, barriers, treatments, décor, etc.

In particular, the use of resin materials is becoming increasingly popular in sculptural and lighting applications. In general, resin materials such as these are now popular compared with decorative cast or laminated glass materials, since resin materials may be manufactured to be more resilient and to have a similar transparent, translucent, or decorative appearance as cast or laminated glass, but with less cost. In addition, resin materials tend to be more flexible in terms of manufacture and assembly because they can be relatively easily bent, molded, colored, shaped, cut, and otherwise modified in a variety of different ways. Decorative resins can also provide more flexibility compared with glass and other conventional materials at least in terms of color, degree of texture, gauge, and impact resistance. Additionally, decorative resins have a fairly wide utility since they may be formed to include a large variety of colors, images, interlayers, and shapes.

Unfortunately, some lighting fixtures made with resin materials are designed to allow for quick, efficient, and inexpensive production. The design of such resin-based lighting fixtures may not focus on, or even allow for, full utilization of the aesthetics that resin-based materials can provide. Along similar lines, many resin-based lighting fixtures are designed for mass production. Mass produced resin-based lighting fixtures, while being relatively inexpensive, can lack uniqueness. Other lighting fixtures made with resin materials are so unique that they typically cannot be mass produced on any appreciable level without, making such unique lighting fixtures costly.

Furthermore, some lighting fixtures made with resin materials require numerous hardware components and/or complicated hardware and installation procedures. Such hardware can be visible and unsightly. Indeed, the mounting hardware of some conventional resin-based lighting fixtures may be unappealing to designers and architects seeking to obtain a certain aesthetic by using resin-based products.

Accordingly, there are a number of disadvantages in resin-based lighting fixtures that can be addressed.

BRIEF SUMMARY OF THE INVENTION

One or more implementations of the present invention solve one or more of the foregoing or other problems with resin-based lighting fixtures that help magnify the aesthetic features of resin-based materials included therein. For example, one or more implementations of the present invention include resin-based lighting fixtures that reduce or eliminate the visibility of hardware. Additionally, one or more implementations include methods of forming resin-based lighting fixtures that allow for the production of unique, aesthetically pleasing, and yet cost effective resin-based lighting fixtures. In particular, one or more implementations include resin-based lighting fixtures having a blossom-shape and leaves or petals made from thermoformed resin sheets.

For example, an implementation of a lighting fixture can include a light socket and a plurality of resin propellers positioned about a light source. Each of the resin propellers can comprise a ring and one or more resin strips extending from the ring. One or more of the resin strips can be non-planar. Additionally, the resin strips can at least partially conceal the light source.

In addition to the foregoing, an implementation of a method of forming a resin-based lighting fixture can involve cutting a plurality of resin propellers from a resin sheet. Each of the resin propellers can comprise a mounting ring and one or more resin strips extending outward from the mounting ring. The method can also involve heating the resin propellers. The method can then involve shaping one or more of the resin strips. Furthermore, the method can involve assembling the resin propellers about a mounting fixture by inserting the mounting fixture through the mounting ring of each resin propeller.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
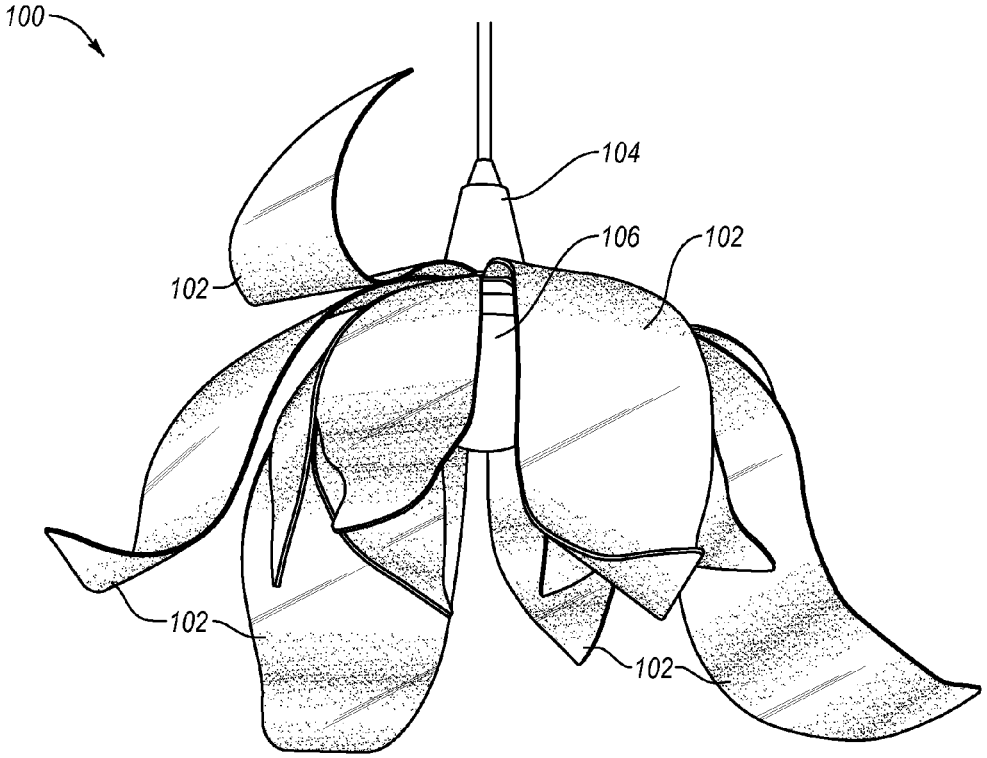
FIG. 1 illustrates a perspective view of a blossom-shaped resin-based lighting fixture in accordance with an implementation of the present invention.

The present invention is directed toward resin-based lighting fixtures that help magnify the aesthetic features of resin-based materials included therein. For example, one or more implementations of the present invention include resin-based lighting fixtures that reduce or eliminate the visibility of hardware. Additionally, one or more implementations include methods of forming resin-based lighting fixtures that allow for the production of unique, aesthetically pleasing, and yet cost effective resin-based lighting fixtures. In particular, one or more implementations include resin-based lighting fixtures having a blossom-shape and leaves or petals made from thermoformed resin sheets.

One will appreciate in light of the disclosure herein that one or more implementations of the present invention can provide aesthetically pleasing light fixtures. For instance, one or more implementations include resin-based lighting fixtures that are hand shaped in aesthetically pleasing configurations. Furthermore, the resin-based light fixtures can help magnify the aesthetic features of the resin materials used to form the light fixtures. Indeed, one or more implementations help magnify the form, texture, and transparency of the resin materials. In addition, one or more implementations reduce or eliminate the visibility of hardware that could otherwise detract from the aesthetics provided by the resin materials.

For example, FIGS. 1-4 illustrate various views of a resin-based lighting fixture 100 in accordance with an implementation of the present invention. As shown by FIGS. 1-4, the resin-based lighting fixture 100 can include a plurality of resin strips 102 secured to a mounting fixture 104 about a light source 106. As an initial matter, the terms "resin," or "resin-based," as used herein, refer to panels, strips or propellers, comprising a substrate of one or more layers or sheets formed from thermoplastic polymers (or alloys thereof). Specifically, such materials can include, but are not limited to, polyethylene terephthalate (PET), polyethylene terephthalate with glycol-modification (PETG), acrylonitrile butadiene-styrene (ABS), polyvinyl chloride (PVC), polyvinyl butyral (PVB), ethylene vinyl acetate (EVA), polycarbonate (PC), styrene, polymethyl methacrylate (PMMA), polyolefins (low and high density polyethylene, polypropylene), thermoplastic polyurethane (TPU), cellulose-based polymers (cellulose acetate, cellulose butyrate or cellulose propionate), or the like.

The resins strips 102 of the resin-based lighting fixture 100 can comprise one or more combinations or alloys of the above-listed thermoplastic materials. As a preliminary matter, implementations of the present invention are described herein primarily with reference to resin strips. One will appreciate, however, that the strips of the lighting fixtures of one or more implementations can include materials other than resin. For example, one or more strips of a given lighting fixture can include wood, stone, fiberglass, or the like.

Furthermore, the resin strips 102 can comprise one or more layers of resin or other materials. For example, in one or more implementations, the resin strips 102 can include a decorative inter-layer, as explained in greater detail below. The decorative inter-layer can provide the resin-based lighting fixture 100 with desirable aesthetic qualities. In addition to, or in place of, a decorative image layer, the resin strips 102 can be transparent, translucent, or opaque, depending upon the desired aesthetic. Furthermore, the resin strips 102 can include color, or can have a clear configuration.

The resin strips 102 can have a gauge from as thin as about one-eighth inch (⅛") or one quarter inch (¼"), or thinner, to as thick as about one and one-half inches (1½") to about two inches (2"), or thicker, depending on the end-user's designs. In general, thicker gauges tend to be sturdier and more expensive than thinner gauges. In accordance with one or more implementations, the resin strips can have thinner gauges, such as anywhere from about one-sixteenth inch (1/16") to about three-eighths inch (⅜").

As shown by FIGS. 1-4, the resin strips 102 can extend about a light source 106. The light source 106 can comprise a light bulb as shown in FIGS. 1-4. In particular, the light source can comprise incandescent lights, fluorescent lights, or light-emitting-diodes ("LEDs"). In any event, the light source 106 can illuminate the resin strips 102 and provide a desirable aesthetic affect in addition to acting as a source of light.

Figure 2:
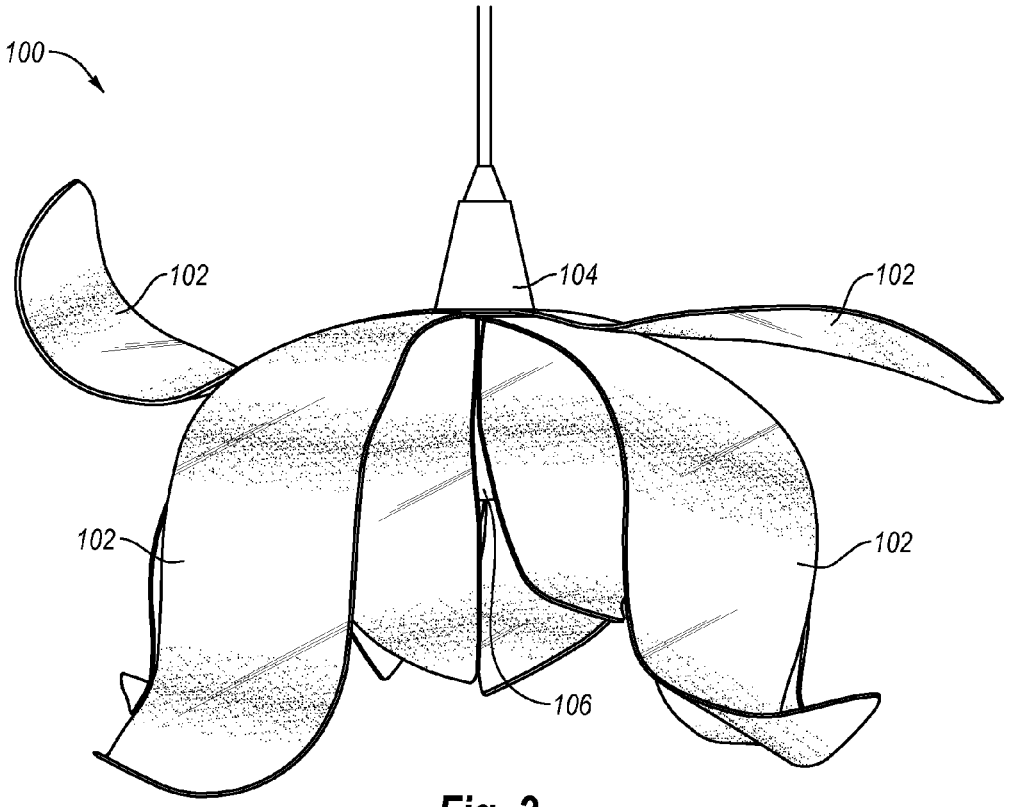
FIG. 2 illustrates an elevational view of the blossom-shaped resin-based lighting fixture of FIG. 1.
Figure 3:
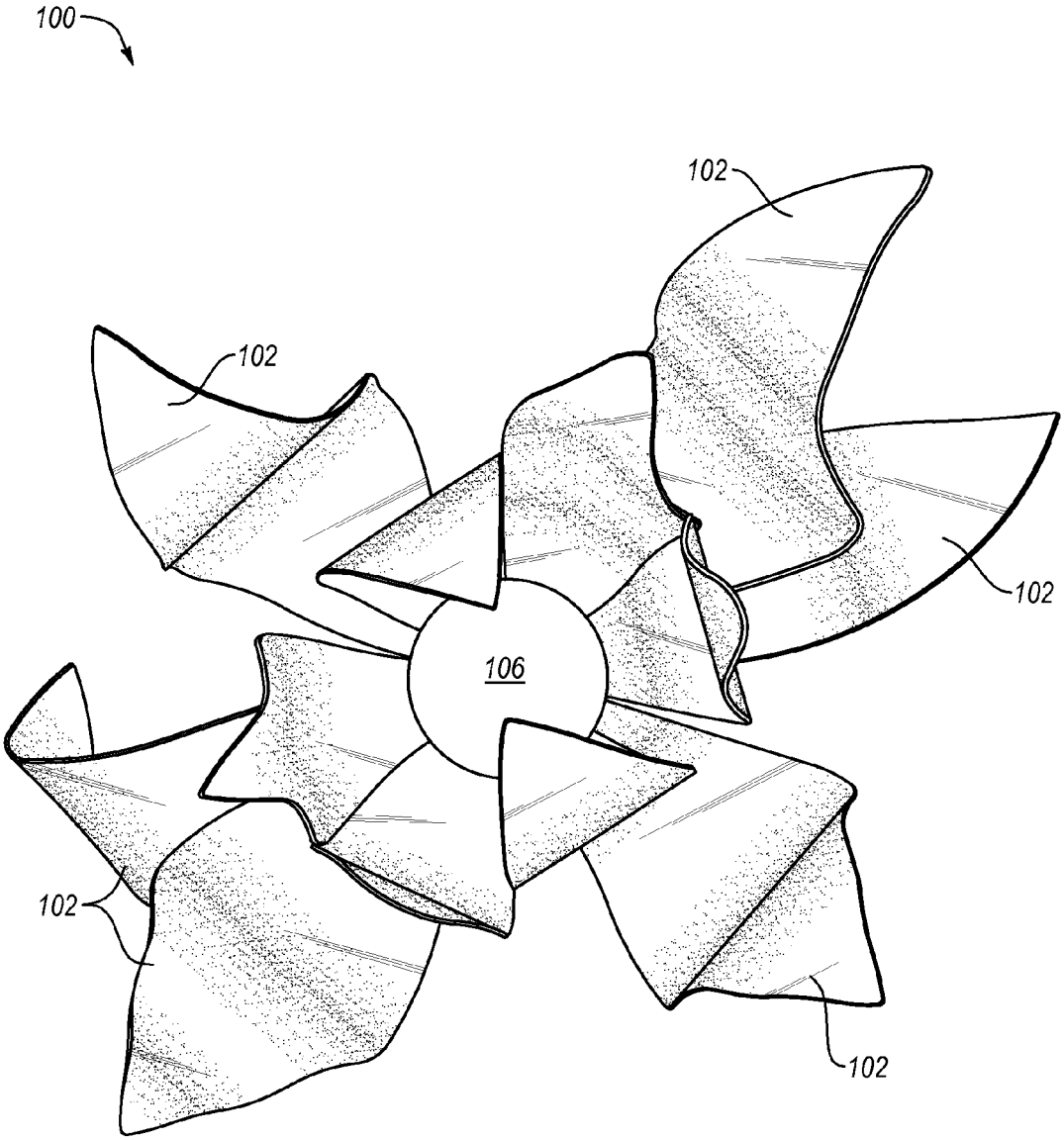
FIG. 3 illustrates a bottom view of the blossom-shaped resin-based lighting fixture of FIG. 1.
Figure 4:
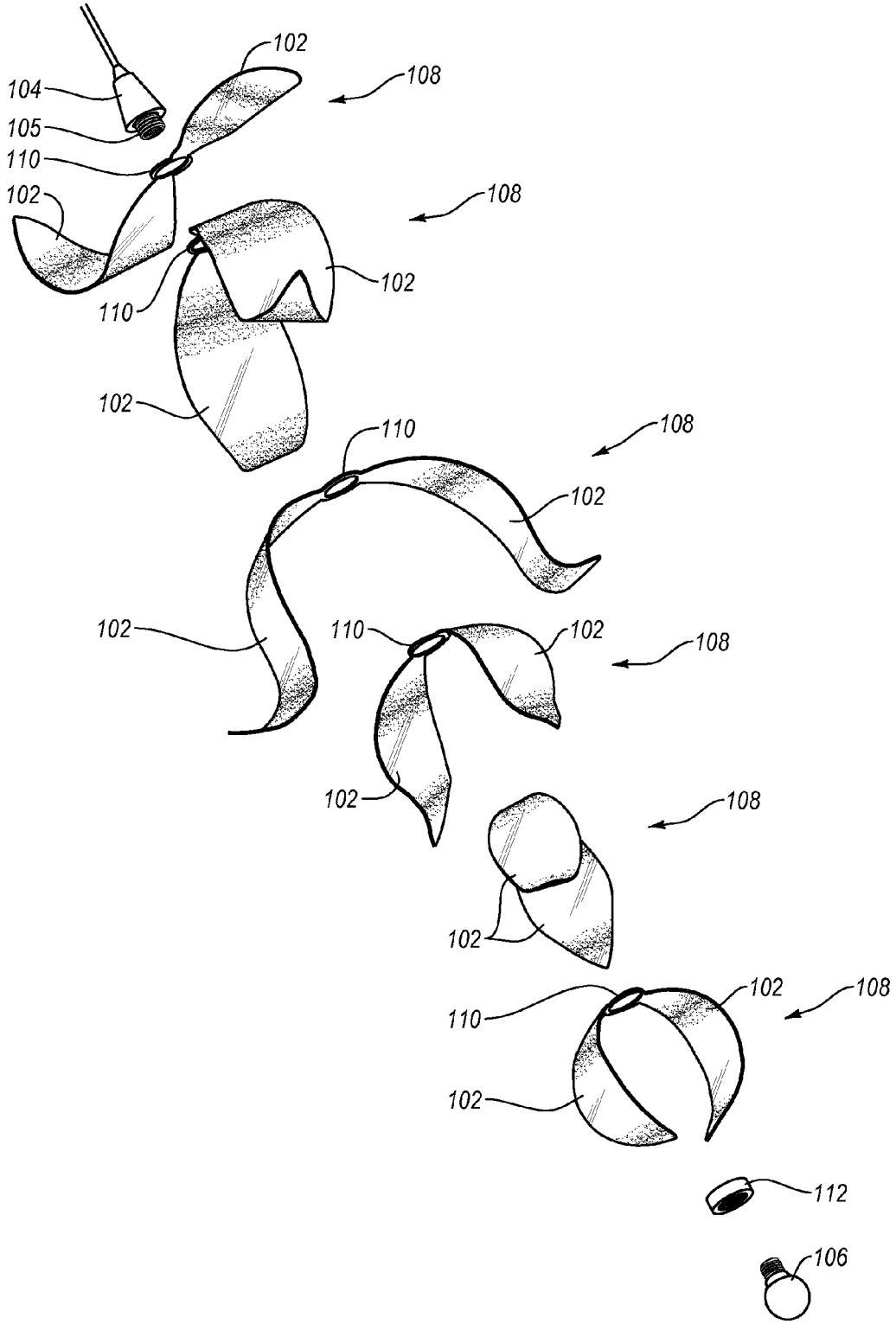
FIG. 4 illustrates an exploded view of the blossom-shaped resin-based lighting fixture of FIG. 1.

The resin strips 102 can have a shape and/or curvature to provide the resin-based lighting fixture with a desirable aesthetic. For example, FIGS. 1-4 illustrate resin strips 102 formed as petals or leaves such that the resin-based lighting fixture 100 has the shape or configuration of a blossom. In additional implementations, however, the resin-based lighting fixture 100 can have alternative shapes or configurations, such as, for example, flowers, ribbons, etc. As shown by FIG. 4, in one or more implementations each resin strip 102 can include different curvature, shape, and/or size from the other resin strips 102. Alternatively, some or all of the resin strips 102 can have the same curvature, shape, and/or size as the other resin strips 102.

FIG. 4 illustrates an exploded view of the resin-based lighting fixture 100. As shown, the resin-based lighting fixture 100 can include a light socket 104, a plurality of propellers 108, a locking mechanism 112, and a light source 106. FIG. 4 further illustrates that each resin strip 102 can form part of a resin propeller 108. Each resin propeller 108 can include a ring 110 and one or more resin strips 102 extending there from. In one or more implementations, the rings 110 of the resin propellers 108 can secure the resin strips 102 to a mounting fixture without the need for other hardware. Thus, in one or more implementations when fully assembled most, if not all, mounting hardware can be concealed from view.

The resin-based lighting fixture 100 can include any number of propellers 108. For example, FIG. 4 shows that the resin-based lighting fixture 100 includes six propellers 108. In alternative implementations, the resin-based lighting fixture 100 can include seven to ten propellers 108, or more. In further implementations, the resin-based lighting fixture 100 can include less than six propellers 108. One will appreciate that a manufacturer can select the number of propellers 108 based on a desired shape or configuration for the resin-based lighting fixture 100.

In addition to the number of propellers 108, the shape and form of the resin propellers 108 can vary. For example, FIG. 4 illustrates that a manufacturer can form each of the resin propellers 108 with varying curvature. Furthermore, the resin propellers 108 can additionally have varying sizes. For instance, FIG. 4 illustrates that the resin propellers 108 closest to the light socket 104 are larger than those farther from the light socket 104. This can allow the larger propellers 108 to fold over the smaller propellers 108.

In one or more implementations, a manufacturer can fold or form the resin propellers 108 and resin strips 102 in a manner to at least partially, or fully, conceal the light source 106. The resin strips 102, however, can be flexible, and thus, allow a user to reposition them to access the light source 106. Thus, the resin strips 102 can provide an aesthetic function of concealing hardware of the resin-based lighting fixture 100, without compromising the functional need to gain access to the light source 106.

To assemble the resin-based lighting fixture 100, a manufacturer can place the rings 110 of the resin propellers 108 about the light socket 104. In so doing, the manufacturer can rotate and otherwise position the resin propellers 108 relative to each other to provide a desired aesthetic. The manufacturer can then secure the locking mechanism 112 to the threads 105 of the light socket 104, thereby securing the resin propellers 108 to the light socket 104. Thereafter, the manufacturer can secure the light source (e.g., light bulb 106) within the light socket 104.

In the illustrated implementation, the light socket 104 includes a male member with external threads. The manufacturer places the male member within the rings 110 of the resin propellers 108 and then secures the locking mechanism 112 to the male member. In this instance, the locking member 112 comprises a ring with internal threads. One will appreciate that in alternative implementations both the light socket 104 and the locking mechanism 112 can have other configurations. For example, the locking mechanism 112 can include a male component, while the light socket 104 includes a female component. Furthermore, instead of a threaded connection, the light socket 104 and the locking mechanism 112 can have a snap fit, or other engagement configuration. In any event, the locking mechanism 112 can secure the resin propellers 108 to the light socket 104.

In one or more alternative implementations, a manufacturer can use a mounting fixture other than a light socket 104 to couple the resin propellers 108 together. In such implementations, the mounting fixture can extend through the rings 110 of the resin propellers 108 and a light socket or a light source can be coupled to the mounting fixture. In at least one implementation, the mounting fixture can comprise an elongated mounting member that allows the manufacturer to space the resin propellers 108 apart and provide a larger and/or fuller configuration. Thus, the resin propellers 108 can be spaced apart in some implementations in contrast to the resin-based lighting fixture 100 where each of the rings 110 are sandwiched together when assembled (FIGS. 1-3).

Figure 5:
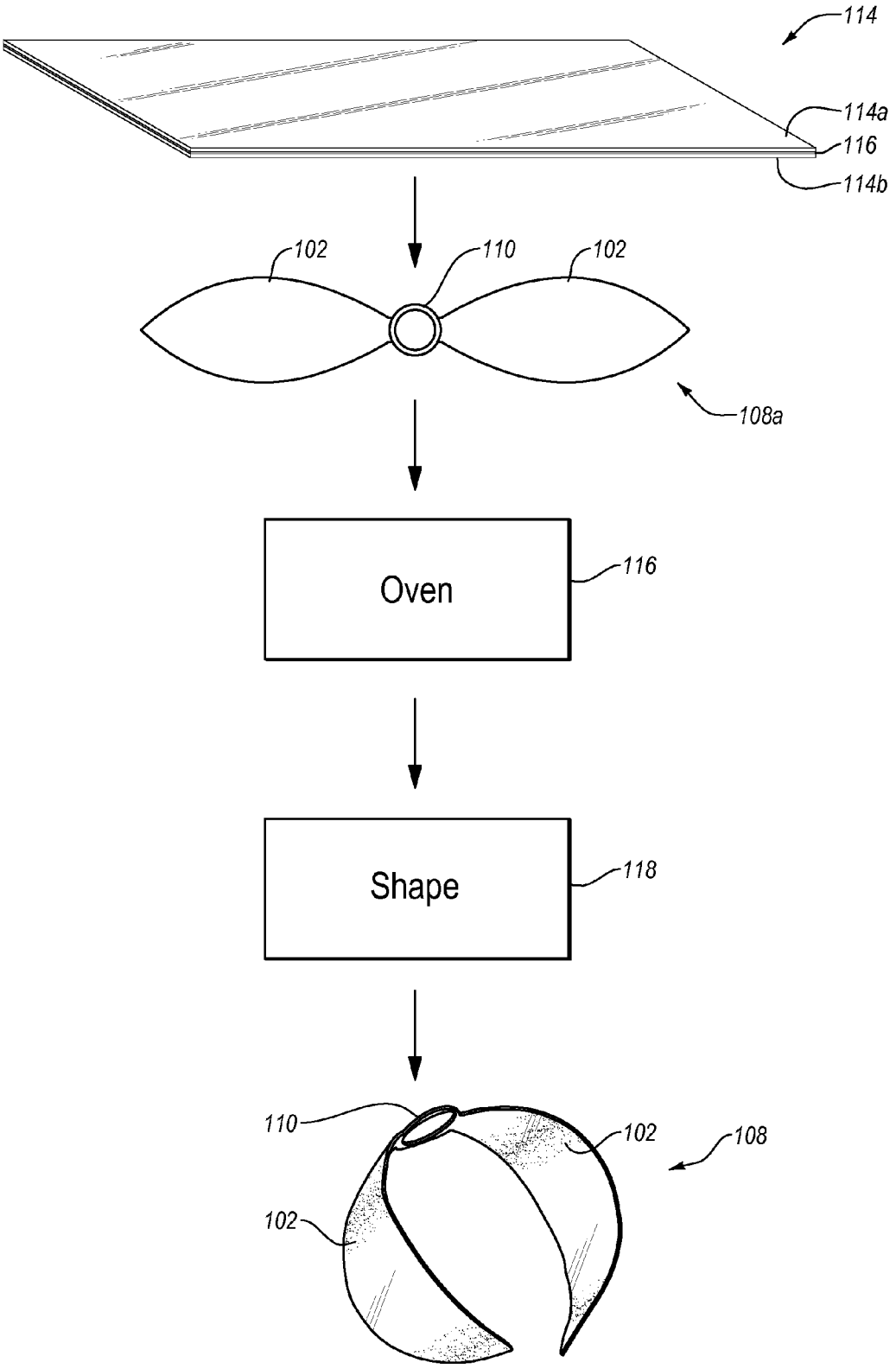
FIG. 5 illustrates an overview schematic diagram for producing a shaped resin-propellers of a resin-based lighting fixture in accordance one or more implementations of the present invention.

Referring now to FIG. 5, a method of forming the resin propellers 108 will be explained. A manufacturer can start with a resin sheet 114. The resin sheet 114 can comprise any number of resin layers or decorative layers. For example, FIG. 5 illustrates that the resin sheet 114 can include outer resin layers **114*a*, 114*b* and an inner decorative layer 116**. The decorative inter-layer can comprise fabric, metallic wire, rod and/or bar, papers, or photographic images. In yet additional implementations, the decorative inter-layer can comprise any organic, inorganic, naturally occurring, or synthetic materials such as rocks, crushed glass, minerals, leaves, twigs, branches, grasses, bamboo shoots, willow, thatch reed, solidified resins, metallic objects, vegetation, and so forth.

To form the resin propellers 108 from the resin sheet 114, a manufacturer can first choose the size and shapes of the resin propellers 108 and associated resin strips 102. The manufacturer can then lay out the shapes on a resin sheet 114. The manufacturer can then cut the resin propellers 108 out of the resin sheet 114. In some implementations, the manufacturer can perform these acts by hand. In alternative implementations, the manufacturer can use a CNC (computer numerically controlled) machine that maximizes the number of resin propellers 108 to be cut from each resin sheet 114. In yet further implementations, the resin propellers 108 can comprise, or be cut from, resin scraps from other projects.

The resin sheets 114 from which a manufacturer can cut the resin propellers 108 can comprise any of the thermoplastic materials described herein above. Furthermore, the resin sheets 114 may have a thickness or gauge of about two inches (2"), about one inch (1"), about one-half inch (½"), about one-fourth inch (¼"), about one-eighth inch (⅛"), about one-sixteenth inch (1/16"), or about one-thirty-second inch (1/32").

After cutting the unshaped resin propellers **108*a* from a resin sheet, the manufacturer can then heat the resin propellers 108*a*. As shown by FIG. 5, the manufacturer can heat the resin propellers 108*a* in oven 116. Alternatively or additionally, the manufacturer can heat the resin propellers 108 in a lamination press, autoclave, vacuum bag, or other thermosetting environment. In any event, the manufacturer can heat the resin propellers 108*a* until they are pliable. One will appreciate that the temperatures to which the manufacturer heats the resin propellers 108 can be dependent upon the particular resins used to form the resin propellers 108. For example, in implementations in which copolyester (e.g., PETG) is used, the manufacturer can place the resin propellers 108*a* in an oven preheated to a temperature of about 350° F. for about one minute. In alternative implementations, the manufacturer can heat the resin propellers to a temperature of between about 180° F. and about 275° F., such as to a temperature of about 225° F. In any event, the manufacturer can heat the resin propellers 108***a* to a temperature near or above their glass transition temperature.

Upon heating the resin propellers 108*a*, the manufacturer can pass the propellers 108*a* through a shaping operation 118. During the shaping operation, the manufacturer can impart curvature or other non-linear geometry to one or more resin strips 102 of the propellers 108*a*. For example, the manufacturer can provide each resin strip 102 with varying degrees of flip.

In one or more implementations, the manufacturer can shape the resin strips 102 by hand. One will appreciate in light of the disclosure herein that shaping the resin strips 102 by hand can provide each resin-based lighting fixture with a unique configuration. In alternative implementations, the manufacture can shape the resin strips 102 by pressing the head resin strips 102 against, or between mold(s). In any event, the manufacturer can provide one or more of the resin strips 102 with curvature or other non-planar geometry. After the shaped resin propellers 108 have cooled, the manufacturer can then use them to assemble a resin-based lighting fixture in the manner described herein above.

As mentioned previously, the resin-based lighting fixture 100 may have any number of configurations and shapes, such as a blossom or flower, or a more abstract configuration. The configuration and style of the resin-based lighting fixture 100 can be based at least partially on the shape and number of resin propellers 108. Thus, a manufacturer can select the size, number, and shape of the resin propellers 108 and resin strips 102 in order to produce a particularly shaped resin-based lighting fixture.

As previously mentioned, the resin propellers 108 can have different sizes. For instance, FIG. 4 illustrates larger propellers near the light socket 104 and smaller propellers near the light source 106. The resin propellers 108 of the present invention can include resin strips 102 having a wide variety of sizes. Each resin propeller 108 illustrated in FIGS. 1-5 includes two resin strips 102 having the same size. In alternative implementations, a single propeller 108 can include resin strips 102 having differing sizes.

Figure 6:
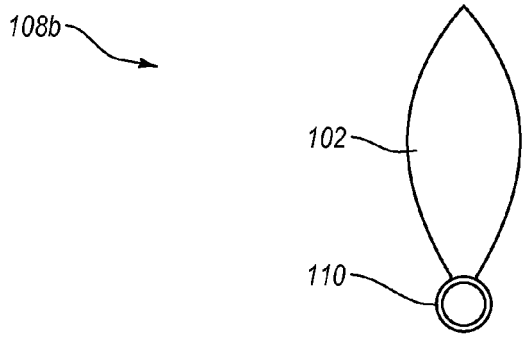
FIG. 6 illustrates a top view of a resin propeller having a single resin strip in accordance with an implementation of the present invention.
Figure 7:
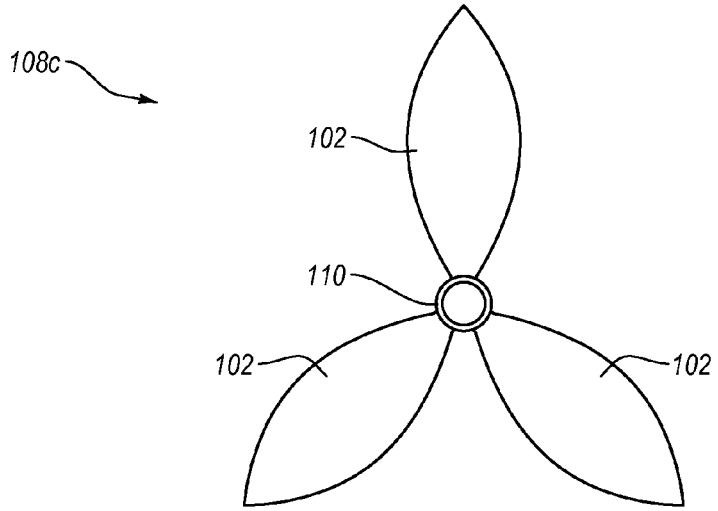
FIG. 7 illustrates a top view of another resin propeller having three resin strips in accordance with an implementation of the present invention.
Figure 8:
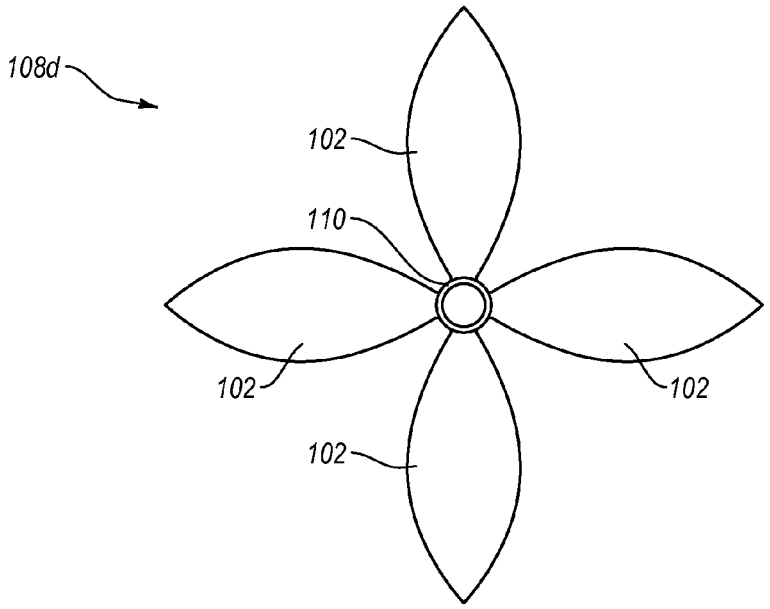
FIG. 8 illustrates a top view of yet another resin propeller having four resin strips in accordance with an implementation of the present invention.

Additionally, while the resin propellers 108 of FIGS. 1-5 include two resin strips 102 each, the present invention is not so limited. Resin propellers 108 of the present invention can include any number of resin strips 102. For example, FIG. 6 illustrates a propeller 108*b* having a single resin strip 102. FIG. 7 illustrates a propeller 108*c* having three resin strips 102. While FIG. 8 illustrates a propeller 108*d* having four resin strips 102. In additional implementations, the resin propellers 108 can include five, six, or more resin strips 102.

Figure 9:
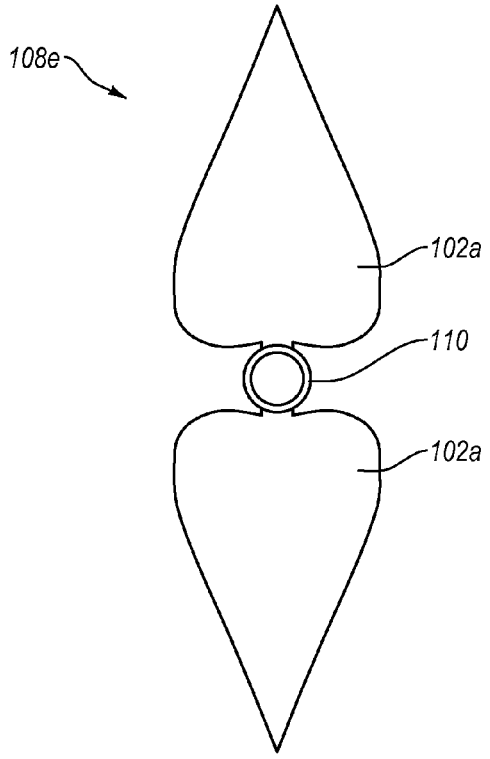
FIG. 9 illustrates a top view of a resin propeller having spade-shaped resin strips in accordance with an implementation of the present invention.
Figure 10:
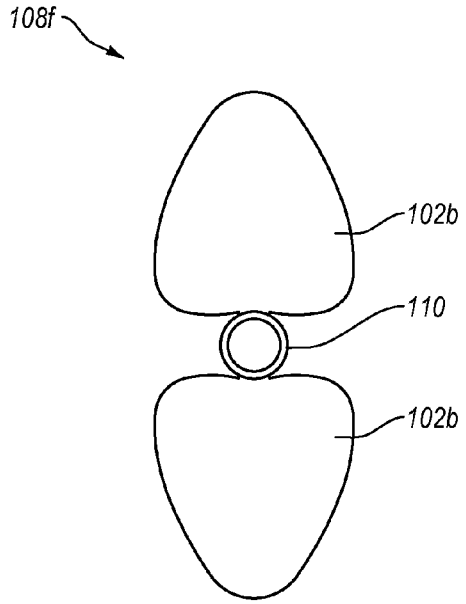
FIG. 10 illustrates a top view of a resin propeller having palm-shaped resin strips in accordance with an implementation of the present invention.
Figure 11:
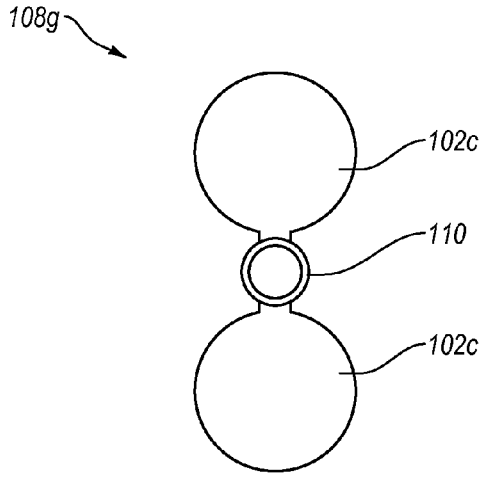
FIG. 11 illustrates a top view of a resin propeller having circular-shaped resin strips in accordance with an implementation of the present invention.
Figure 12:
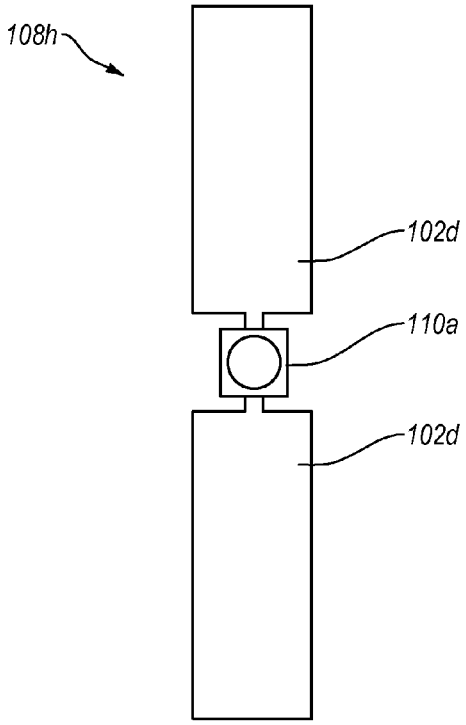
FIG. 12 illustrates a top view of a resin propeller having rectangular-shaped resin strips in accordance with an implementation of the present invention
Figure 13:
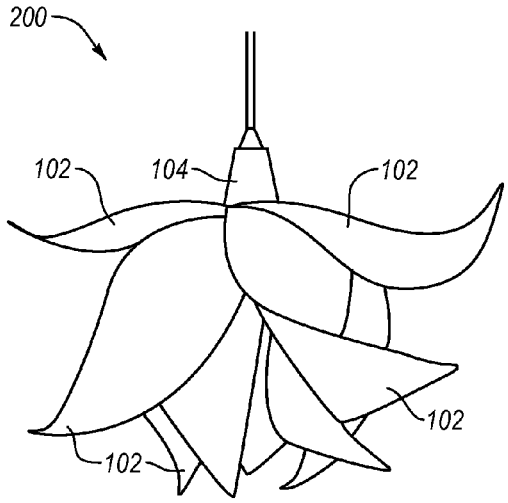
FIG. 13 illustrates a side view of another resin-based lighting fixture in accordance with an implementation of the present invention.
Figure 14:
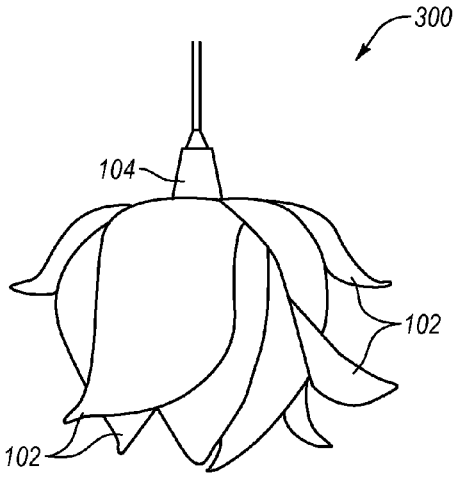
FIG. 14 illustrates a side view of yet another resin-based lighting fixture in accordance with an implementation of the present invention.
Figure 15:
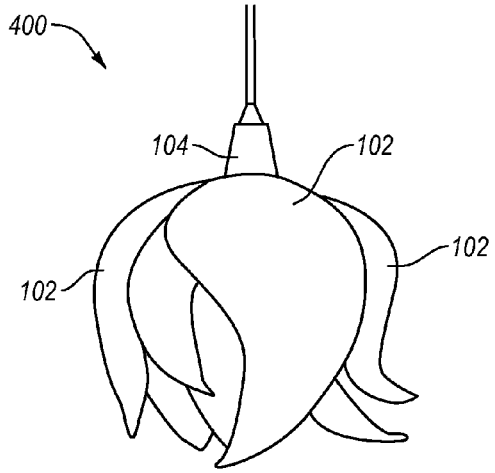
FIG. 15 illustrates a side view of an additional resin-based lighting fixture in accordance with an implementation of the present invention.
Figure 16:
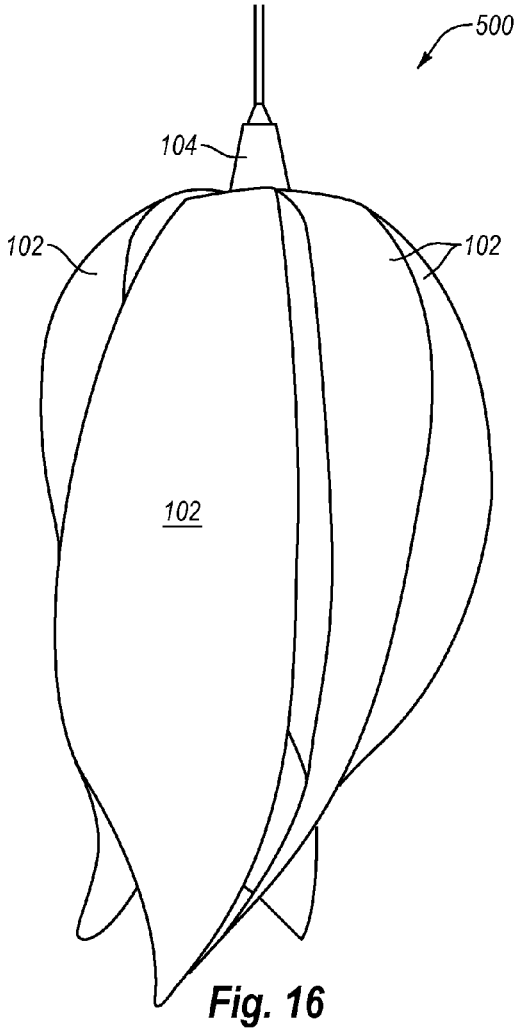
FIG. 16 illustrates a side view of yet an additional resin-based lighting fixture in accordance with an implementation of the present invention.

In addition to having varying sizes and numbers, the resin strips 102 of the present invention can also include various shapes and configurations. As previously discussed, the resin strips 102 shown and described in reference to FIGS. 1-8 have a petal or leaf shape. In alternative implementations, the resin propellers 108 can have other shapes and configurations, such as those shown in FIGS. 9-12. For example, FIG. 9 illustrates a propeller 108*e* having spade-shaped resin strips 102*a*. FIG. 10 illustrates a propeller 108*f* having palm-shaped resin strips 102*b*. FIG. 11 illustrates a propeller 108*g* having circular-shaped resin strips 102*c*. Finally, FIG. 12 illustrates a propeller 108*h* having rectangular-shaped resin strips 102*d*. Thus, one will appreciate in light of the disclosure herein that the resin propellers 108 can comprise any number, size, and/or shape of resin strips 102.

Addition to the resin strips 102, the rings or mounting rings 110 of the propellers 108 can have various shapes and sizes. For example, FIGS. 6-11 illustrate circular rings 110, while FIG. 12 illustrates a square ring 110*a*. Furthermore, the rings 110 can be the same gauge as the resin strips 102 or be thicker to provide spacing between the propellers 108.

One will appreciate in light of the disclosure herein that a manufacturer can vary the shape and configuration of the resin-based lighting fixture 100 by varying the shape, curvature, and/or number of propellers 108 and associated resin strips 102. For example, FIGS. 13-16 illustrate four different resin-based lighting fixtures 200, 300, 400, and 500 each including a plurality of shaped resin strips 102 secured about a mounting fixture (i.e., light socket 104). As shown, the ability to manipulate and shape the resin strips 102 allows a manufacturer to create a wide variety of different shapes and configurations, blossoms or otherwise.

Figure 17:
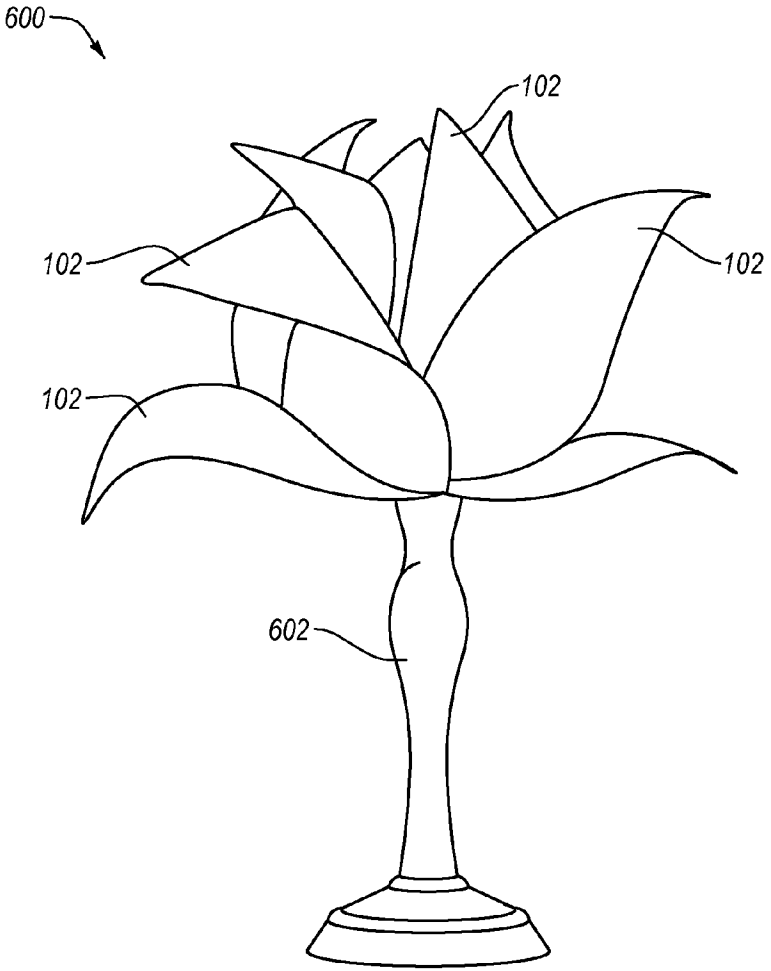
FIG. 17 illustrates a side view of a still another resin-based lighting fixture in accordance with an implementation of the present invention.

Each of the resin-based lighting fixtures 100, 200, 300, 400, 500 shown and described herein above includes a pendant or hanging light configuration. One will appreciate in light of the disclosure herein that the present invention is not so limited. In alternative implementations, the resin-based lighting fixtures can comprise chandeliers, wall sconces, lamps, lights of ceiling fans, outdoor lighting, etc. For example, FIG. 17 illustrates a lamp lighting fixtures 600 including a plurality of resin strips 102 formed as a blossom about a light source and attached to a lamp stand 602.

One will appreciate that a manufacturer can design or configure a resin-based lighting fixture in almost limitless configurations using the principles of the present invention. For example, a manufacturer can modify the color and opacity/translucence of the resin strips 102 in any number of ways to adjust the opacity/transparency of the resin-based lighting fixture for desired aesthetic effect. In at least one implementation, a manufacturer can modify the hue, color intensity, and light transmission of the resin strips 102 and/or the decorative inter-layer 116 to vary the resultant aesthetic properties of the resin-based lighting fixture. Accordingly, one or more implementations of the present invention provide a manufacturer with a number of ways to prepare an aesthetically desirable resin-based lighting fixture. These resin-based lighting fixtures can have a wide range of shapes, sizes, thicknesses, properties or colors, and can be used in a wide range of environments and applications.

Figure 18:
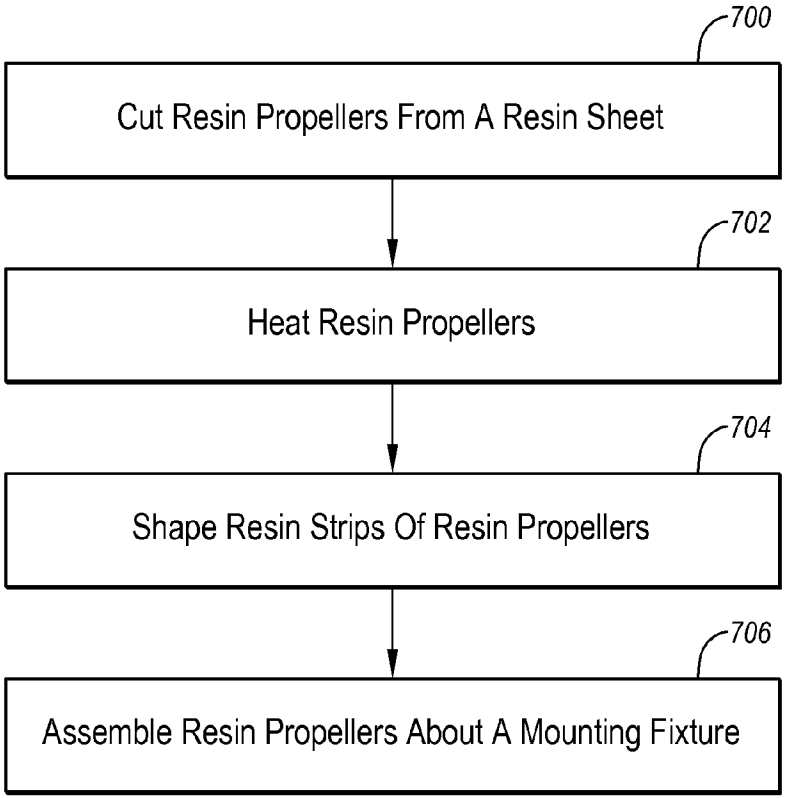
FIG. 18 illustrates a flowchart of a series of acts in a method of forming a resin-based lighting fixture in accordance with an implementation of the present invention.

Accordingly, FIGS. 1-17, the corresponding text, provide a number of different components and mechanisms for aesthetically pleasing resin-based lighting fixtures. In addition to the foregoing, implementations of the present invention can also be described in terms of flowcharts comprising acts and steps in a method for accomplishing a particular result. For example, FIG. 18 illustrates a flowchart of one exemplary method for producing a resin-based lighting fixture 100, 200, 300, 400, 500, 600 using principles of the present invention. The acts of FIG. 18 are described below with reference to the components and diagrams of FIGS. 1 through 17.

For example, FIG. 18 shows that a method of creating a resin-based lighting fixture 100, 200, 300, 400, 500, 600 comprises an act 700 of cutting resin propellers from a resin sheet. For example, act 700 can involve cutting a plurality of resin propellers 108 from a resin sheet 114. Each of the resin propellers 108 can comprise a mounting ring 110 and one or more resin strips 102, 102*a-d* extending outward from the mounting ring 110.

In addition, FIG. 18 shows that the method can comprise an act 702 of heating the resin propellers 108*a-h*. Act 702 can include heating the resin propellers 108*a-h* to a processing temperature approximately equal to the glass transition temperature of the resin material(s) of the resin propellers 108*a-h*. For example, a manufacturer can heat the resin propellers 108*a-h* to a temperature of between about 180° F. and about 400° F., such as a temperature of about 350° F. or about 225° F. The manufacturer can heat the resin propellers 108*a-h* in an oven, lamination press, autoclave, vacuum bag, or other thermosetting environment.

FIG. 18 also shows that the method comprises an act 704 of shaping the resin strips of the resin propellers. Act 704 can include shaping one or more of the resin strips 102, 102*a-d*, only some of the resin strips 102, 102*a-d*, or all of the resin strips 102, 102*a-d* of each resin propeller 108*a-h*. The method can include shaping the resin strips 102, 102*a-d* by hand, using a mold, or other mechanism. Act 704 can involve providing each 102, 102*a-d* with a unique or the same curvature.

In addition to the foregoing, FIG. 18 shows that the method can comprise an act 706 of assembling the resin propellers about a mounting fixture. Act 706 can involve assembling the resin propellers 108*a-h* about a mounting fixture (such as a light socket 104) by inserting the mounting fixture through the mounting ring 110 of each resin propeller 108*a-h*. Additionally, act 706 can involve arranging the one or more resin strips 108*a-h* into a blossom or flower configuration.

Accordingly, the schematics and methods described herein provide a number of unique products, as well as ways for creating aesthetically pleasing, decorative, resin-based lighting fixtures. As discussed herein, these resin-based lighting fixtures or example reduce or eliminate the visibility of hardware. One or more implementations include resin-based lighting fixtures having a blossom-shape and leaves or petals made from thermoformed resin sheets.

The present invention may thus be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A method of forming a lighting fixture, comprising:

cutting a plurality of resin propellers from a resin sheet, each of the resin propellers comprising a mounting ring and one or more resin strips extending outward from the mounting ring;

heating the resin propellers;

shaping one or more of the resin strips; and assembling the resin propellers about a mounting fixture by inserting the mounting fixture through the mounting ring of each resin propeller thereby forming the lighting fixture.

2. The method as recited in claim 1, further comprising arranging the one or more resin strips into a blossom or flower configuration.

3. The method as recited in claim 1, wherein heating the resin propellers comprises heating the resin propellers to a temperature approximately equal to a glass transition temperature of the resin propellers.

4. The method as recited in claim 1, wherein:

the resin propellers comprise PETG; and heating the resin propellers comprises placing the resin propellers in an oven preheated to about 350° F. for a period of about one minute.

5. The method as recited in claim 1, further comprising securing a locking mechanism about the mounting fixture.

6. The method as recited in claim 1, further comprising pressing the one or more resin strips against a mold.

7. The method as recited in claim 1, wherein shaping the one or more resin strips comprises imparting a curvature to the one or more resin strips by hand.

8. The method as recited in claim 1, further comprising securing a light source to the mounting fixture.

* * * * *